US005373272A

United States Patent [19]

Scheel et al.

[11] Patent Number: 5,373,272

[45] Date of Patent: Dec. 13, 1994

[54] HIGH CURRENT CAPACITY BLADE FOR A CIRCUIT BREAKER

[75] Inventors: Jerry L. Scheel; Randall L. Siebels, both of Cedar Rapids; Matthew D. Sortland, Swisher; John M. Winter, Cedar Rapids, all of Iowa

[73] Assignee: Square D Company, Palatine, Ill.

[21] Appl. No.: 180,690

[22] Filed: Jan. 13, 1994

[51] Int. Cl.[5] ..... H01H 75/00

[52] U.S. Cl. ..... 335/16; 335/172

[58] Field of Search ..... 335/167–176, 335/23, 35, 8–10, 16, 147, 195; 200/147 R

*Primary Examiner*—Lincoln Donovan

*Attorney, Agent, or Firm*—Larry I. Golden; Kareem M. Irfan

[57] ABSTRACT

A high current capacity blade for a circuit breaker, comprises a conductive blade body having front and rear sections connected to one another, where the rear section includes a surface attachment area for fastening a flexible connector of the circuit breaker thereto. A strain relief tang extending from the rear section of the blade body is used to engage the flexible connector so as to stabilize the fastening of the flexible connector to the surface attachment area. A broad conductive lateral section is connected to and extends laterally from the front section, and includes a blade tab for engaging a toggle spring of the circuit breaker. A broad moveable contact is mounted on the broad lateral section and is adapted to interface with a stationary contact of the circuit breaker. A pair of substantially parallel L-shaped blade legs are spaced from one another to permit the toggle spring to pass therebetween. Each of the blade legs has first and second ends with the first ends connected to the rear portion of the blade body and the second ends including respective blade pivots for engaging notches in a handle of the circuit breaker. The assembly accommodates automated Z-axis assembly.

9 Claims, 3 Drawing Sheets

HIGH CURRENT CAPACITY BLADE FOR A CIRCUIT BREAKER

FIELD OF THE INVENTION

The present invention relates generally to circuit breakers and, more particularly, to a high current capacity blade for a circuit breaker.

BACKGROUND OF THE INVENTION

Use of circuit breakers is widespread in modern-day residential, commercial and industrial electric systems, and they constitute an indispensable component of such systems toward providing protection against over-current conditions. Various circuit breaker mechanisms have evolved and have been perfected over time on the basis of application-specific factors such as current capacity, response time, and the type of reset (manual or remote) function desired of the breaker.

One type of circuit breaker mechanism employs a thermo-magnetic tripping device to "trip" a latch in response to a specific range of over-current conditions. The tripping action is caused by a significant deflection in a bi-metal or thermostatmetal element which responds to changes in temperature due to resistance heating caused by flow of the circuit's electric current through the element. The thermostat metal element is typically in the form of a flat metal member and operates in conjunction with a latch so that metal member deflection releases the latch after a time delay corresponding to a predetermined over-current threshold in order to "break" the current circuit associated therewith. Circuit breaker mechanisms of this type often include an electro-magnet operating upon a lever to release the breaker latch in the presence of a short circuit or very high current condition. A handle or push button mechanism is also provided for opening up the electric contacts to the requisite separation width and Sufficiently fast to realize adequate current interruption.

Another type of circuit breaker, referred to as a "double-break" circuit breaker, includes two sets of current-breaking contacts to accommodate a higher level of over-current conditions than is accommodated by the one discussed above. One such double-break circuit breaker implements its two sets of contacts using the respective ends of an elongated rotatable blade as movable contacts which meet non-movable contacts disposed adjacent the non-movable contacts. The non-movable contacts are located on the ends of respective U-shaped stationary terminals, so that an electro-magnetic blow-off force ensues when the current, exceeding the threshold level, passes through the U-shaped terminals. Thus, when this high-level over-current condition is present, the blow-off force causes the elongated rotatable blade to rotate and the two sets of contacts to separate simultaneously.

Another type of double-break circuit breaker implements its two sets of contacts using separate and independent structures. For example, one set of contacts may be implemented using the previously-discussed thermo-magnetic tripping device to trip the current path at low-level current conditions, and the other set of contacts using an intricate and current-sensitive arrangement which separates its contacts in response to high-level blow-off current conditions. See, for example, U.S. Pat. Nos. 3,944,953, 3,96,346, 3,943,316 and 3,943,472, each of which is assigned to the instant assignee.

While providing adequate protection to high-level over-current conditions, there is still a need for a circuit breaker structure, useful with both single-break and double-break circuit breakers, which accommodates extremely high levels of current in a relatively small package.

SUMMARY OF THE INVENTION

An object of the present invention is to provide a circuit breaker blade having a high current capacity. A related object is to provide a circuit breaker blade capable of handling the high contact force required for the high current capacity.

Another object of the present invention is to provide a circuit breaker blade having a high interruption capacity and, therefore, a high operational performance.

In a particular embodiment, these objects are realized by providing a high current capacity blade for a circuit breaker, comprising a conductive blade body having front and rear sections connected to one another, where the rear section includes a surface attachment area for fastening a flexible connector of the circuit breaker thereto. A strain relief tang extending from the rear section of the blade body is used to engage the flexible connector so as to stabilize the fastening of the flexible connector to the surface attachment area. A broad conductive lateral section is connected to and extends laterally from the front section, and includes a blade tab for engaging a toggle spring of the circuit breaker. A broad moveable contact is mounted on the broad lateral section and is adapted to interface with a stationary contact of the circuit breaker. A pair of substantially parallel L-shaped blade legs are spaced from one another to permit the toggle spring to pass therebetween. Each of the blade legs has first and second ends with the first ends connected to the rear portion of the blade body and the second ends including respective blade pivots for engaging notches in a handle of the circuit breaker.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
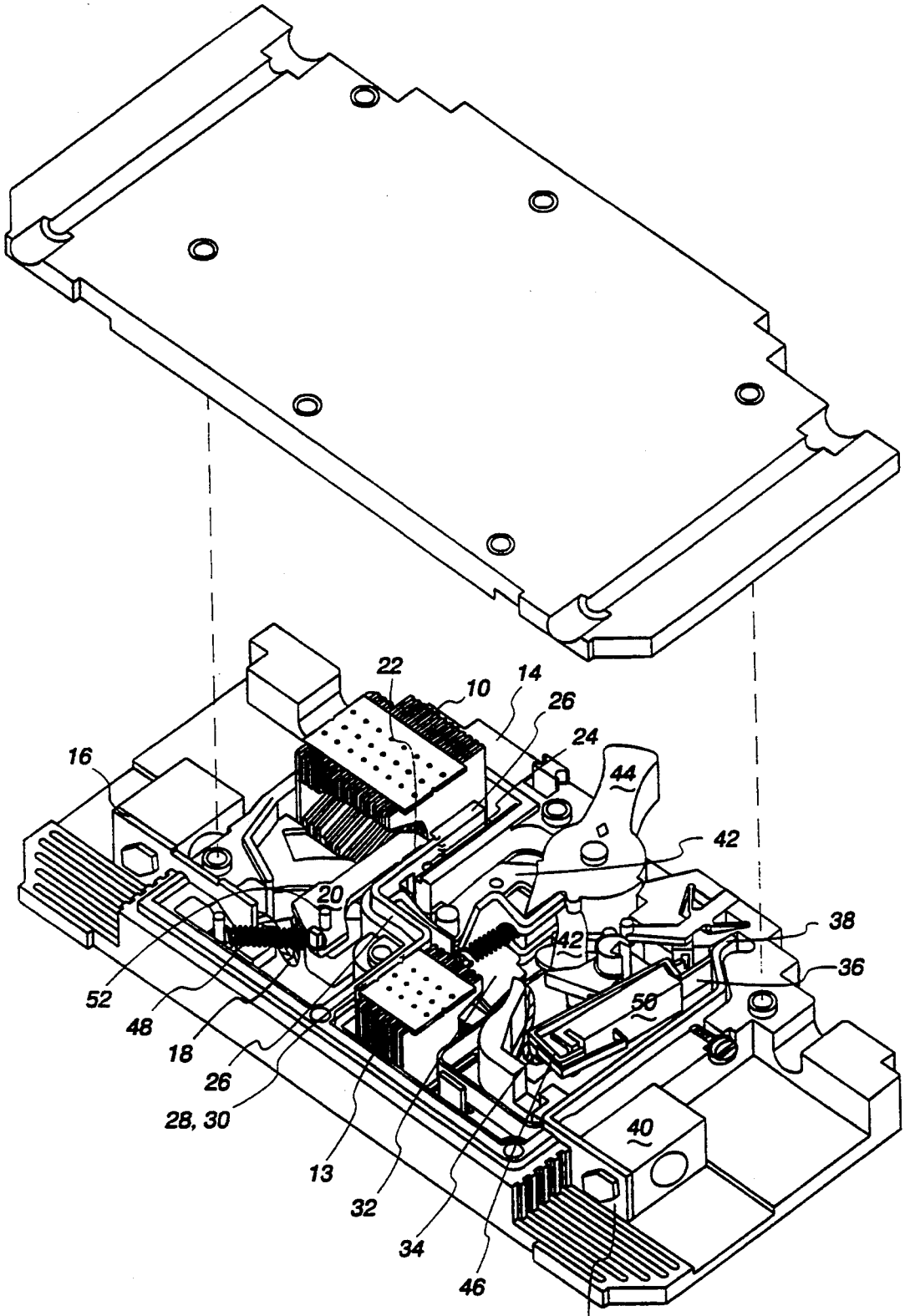
FIG. 1 is a side view of a series double breaker circuit breaker including a primary blade embodying the present invention.

While the invention is susceptible to various modifications and alternative forms, a specific embodiment thereof has been shown by way of example in the drawings and will be described in detail. It should be understood, however, that it is not intended to limit the invention to the particular form described. On the contrary, the intention is to cover all modifications, equivalents and alternatives falling within the spirit and scope of the invention as defined by the appended claims.

DESCRIPTION OF THE PREFERRED EMBODIMENTS

Turning now to the drawings, FIG. 1 illustrates the basic configuration of a primary blade 32 embodying the present invention in the context of a double-break circuit breaker. The present invention is discussed in the context of such an exemplary double-break circuit breaker for illustrative purposes only, and the particular circuit breaker illustrated and described (FIG. 2) should not be construed to limit the possible applications for the present invention, as these applications encompass a wide variety of circuit breaker types. To fully appreciate the utility of the present invention, however, the double-break circuit breaker of FIG. 1 will first be described, followed by a detailed description of the primary blade 32, which embodies the principles of the present invention.

The circuit breaker of FIG. 1 includes a circuit breaker base 14 which carries all of the internal components of the circuit breaker. The current path through the circuit breaker begins at a line terminal 16, and from the line terminal 16 the current path goes through a flexible pigtail 18. The flexible pigtail 18 is attached to a secondary blade 20 with a moveable contact 22 mating with a stationary contact 24. Current flows through the moveable and stationary contacts 22, 24 to the mid terminal 26, which is configured in an S form. The other side of the mid terminal 26 includes another stationary contact 28 connected thereto. Positioned opposite the stationary contact 28 is a mating moveable contact 30 attached to the primary blade 32. Current flows through the stationary and moveable contacts 28, 30, through the primary blade 32, and into one end of a primary flexible connector or pigtail 34. The other end of the primary flexible connector 34 is attached to a bimetal 36, which provides the thermal tripping characteristics for the circuit breaker. Finally, the current flows from the bimetal 36 through a load terminal 38 and out of the load end of the circuit breaker via a lug 40.

The primary section of the circuit breaker includes the primary blade 32, a trip lever 42, a handle 44, a magnetic armature 46, a pigtail 34, and a primary arc stack 13. The secondary section includes the secondary blade 20, the pigtail 18, an extension spring 48, and a secondary arc stack 10. In the illustrated circuit breaker, using conventional magnetic and thermal trip protection features, the primary section provides the breaking capacity for all levels of current from one ampere to approximately 3000 amperes without operational assistance from the secondary section. The magnetic armature 46 is drawn to a yoke 50 during high current flow. This allows the trip lever 42 to disengage from the magnetic armature 46 and rotate to the trip position, which, in turn, allows the primary blade contact 30 to separate from the stationary contact 28 to break the current flow. As the contacts 28, 30 are separated, an are voltage is generated in the primary arc stack 13. A thermal trip via the bimetal 36 results in the same sequence of events and, additionally, results in the trip lever 42 disengaging from the magnetic armature 46.

The normal ON and OFF operation of the primary blade 32 occurs in response to rotation of the handle 44 in a clockwise or counterclockwise motion. In response to rotation of the handle 44 in either direction, the primary blade 32 either opens or closes the circuit via the primary moveable contact 30 and the primary stationary contact 28. Rotation of the primary blade 32 is tied directly to the handle 44 for the normal ON and OFF operation of the primary blade 32. Furthermore, the secondary section is not affected by the normal ON and OFF operation of the primary blade 32. The secondary blade contact 22 and the secondary stationary contact 24 remain closed.

As previously explained, the secondary section of the circuit breaker has limited operation below 3000 amperes of fault current. However, at current levels above 3000 amperes, the secondary section begins to contribute to interruption performance. In particular, the secondary blade 20 derives contact force from the extension spring 48. The secondary blade 20 pivots about the blade pivot 52 with the extension spring 48 extended as the secondary blade 20 opens up in response to a current fault above 3000 amperes. There is no linkage of the secondary blade 20 to the primary blade 32, but rather the operation of the secondary and primary blades 20, 32 is totally separate and independent.

In response to the occurrence of a current fault above 3000 amperes, the constriction resistance of the secondary blade contact 22 and the secondary stationary contact 24 provides a magnetic force that tries to separate the contacts. Simultaneously, the current path configuration of the mid terminal 26 and the secondary blade 20 forms a magnetic blowoff loop which also tries to separate the contacts 22, 24. The addition of both of these opening forces to the secondary blade 20 causes the secondary blade 20 to separate at the contacts 22, 24. As the secondary blade 20 opens, the extension spring 48 begins to stretch. The extension spring 48 permits the secondary blade 20 to continue to open as long as the force to open the blade is greater than the extension force of the spring 48. As the contacts 22, 24 are separated, an arc voltage is generated in the secondary arc stack 10. The combination of the are voltage generated by the secondary are stack 10 and the arc voltage generated by the primary arc stack 13 make these voltages add together. This allows a very fast rise of are voltage and also allows high levels of arc voltage consistent with double break circuit breakers.

As the current fault level rises higher and higher above 3000 amperes, the faster and higher the secondary blade 20 will be moved. As the interruption takes place and the electric are is extinguished in the primary and secondary sections, the secondary blade 20 is biased to return to the closed position because of the spring bias from the extension spring 48. The primary blade 32 remains in the open or tripped position. At this point, the interruption of the current fault is complete with no opportunity to re-establish itself.

Figure 2:
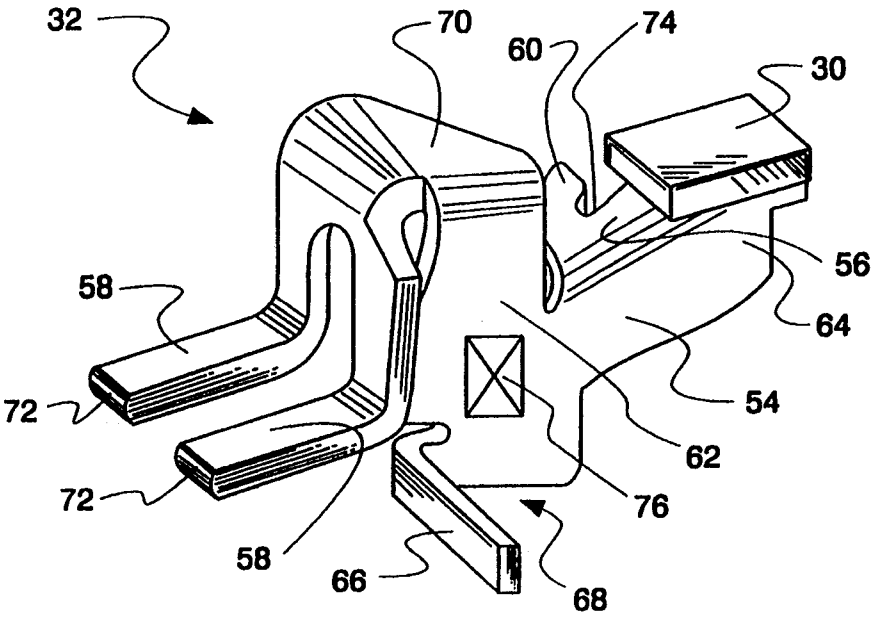
FIG. 2 is a perspective view of a primary blade embodying the present invention.

For further information regarding the overall construction and operation of the circuit breaker shown in FIG. 2, reference may be made to U.S. patent application Ser. No. 08/81,289, entitled "Circuit Breaker Having Double Break Mechanism", filed concurrently herewith, assigned to the instant assignee and incorporated herein by reference.

Figure 3:
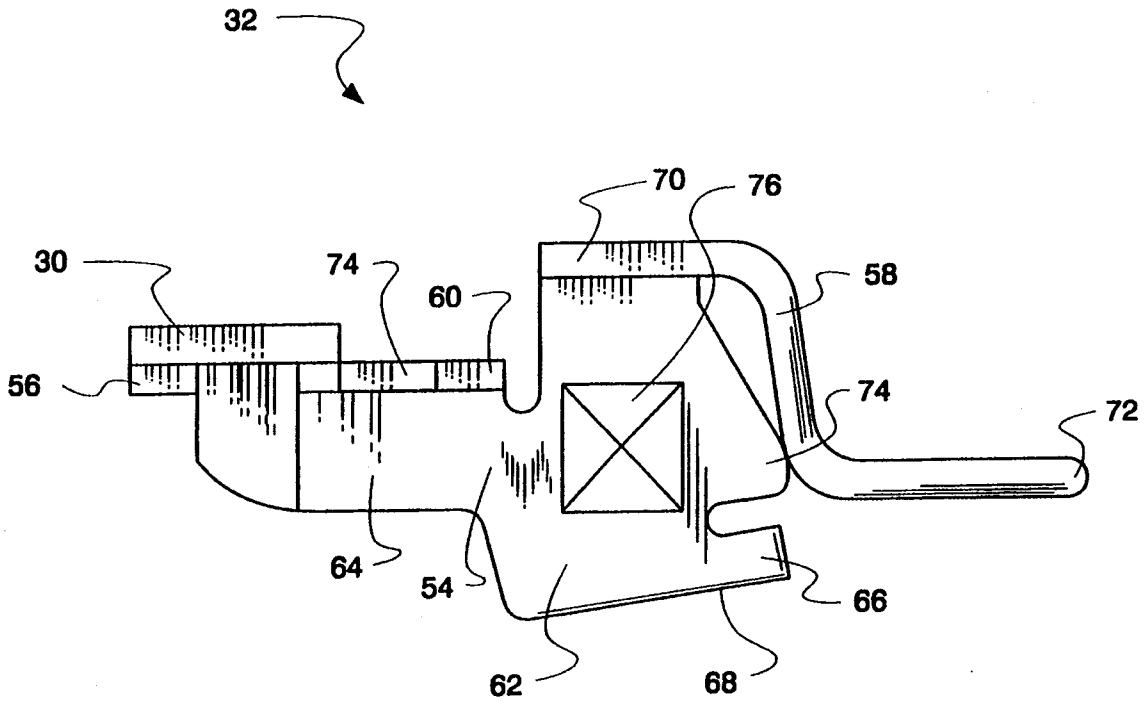
FIG. 3 is a side view of the primary blade shown in FIG. 2.

FIGS. 2 and 3 illustrate the high current capacity primary blade 32 embodying the present invention and related to the blade shown in FIG. 12 of U.S. patent application Ser. No. 07/878648 (issuing as U.S. Pat. No. 5,245,302 on Sep. 14, 1993), incorporated herein by reference. The primary blade 32 includes an integral blade body 54 bridging an integral lateral section 56 and a pair of blade legs 58. At one end, the lateral section 56 includes the moveable contact 30 connected thereto and interfacing with the stationary contact 28 (see FIG. 1). At the other end, the lateral section 56 includes a blade tab 60 for engaging one end of a toggle spring (not shown). The primary blade 32 is z-axis assembled into the base 14 of the circuit breaker in such a way as to attach the blade tab 60 to a triplever hook via the toggle spring. Also, the blade legs 58 are engaged with respective notches in the circuit breaker handle 44. The primary blade 32 is situated in the base 14 with the blade body 54 positioned substantially parallel to the inner surface of base 14 and the lateral section 56 extending upwardly in a direction away from the inner surface of the base 14.

The blade body 54 is integrally connected to the lateral section 56 and is positioned substantially orthogonal to the lateral section 56. The blade body 54 includes a rear portion 62 and a front portion 64 adjacent the lateral section 56. The rear and front portions 62, 64 are configured in the manner illustrated in FIG. 2. In particular, the rear portion 62 is wider than the front portion 64, and the front portion is connected to the approximate middle of the rear portion 62. The flexible connector 34 (see FIG. 1) is fastened to the surface attachment area 76 of the rear portion 62. This attachment is stabilized using a strain relief tang 66 connected to the rear portion 62 and extending laterally from the rear portion 62 in a direction opposite the lateral section 56. To stabilize the connection between the flexible connector 34 and the area 76 using the strain relief tang 66, the flexible connector 34 is inserted into the region labelled 68 and crimped therein by the strain relief tang 66. In crimping the flexible connector 34 in the region 68, the strain relief tang 66 is rotatably bent toward the rear portion 62 so that the flexible connector 34 is "sandwiched" between the strain relief tang 66 and the rear portion 62. The design of the strain relief tang 66 permits the strain relief tang 66 to secure a large flexible connector or multiple flexible connectors in the region 68.

The pair of blade legs 58 are integrally connected to the rear portion 62 of the blade body 54 via a lateral waist section 70 extending in the same direction as the lateral section 56. The blade legs 58 are formed substantially parallel to one another and are spaced from one another to permit the toggle spring to pass therebetween. The blade legs 58 are formed with respective right-angled bends as shown in FIG. 2 and terminate in blade pivots 72. The blade pivots 72 are biased to sit in notches in the circuit breaker handle 44 shown in FIG. 1 because of the force applied by the toggle spring in connecting the blade tab 60 to the triplever hook adjacent the handle 44.

Since the primary blade 32 is a high current capacity blade, the contact force required for the blade 32 is relatively high (28 to 30 ounces). This contact force is generated from a relatively strong force applied by the toggle spring, and the blade 32 includes several features designed to withstand this relatively strong force. First, the blade pivots 72 are rounded, i.e., have rolled radii. The rolled radii facilitate pivoting of the pivots 72 within the notches of the circuit breaker handle 44. Second, as best shown in FIG. 3, the upper "thigh" portion of one of the blade legs 58 abuts against the rear edge 74 of the blade body 54. The purpose of having the blade leg 58 touch the blade body 54 is to provide additional support to the blade body 54. Since the toggle spring applies a relatively strong force to the blade body 54 which is partially directed toward the blade legs 58, the blade body 54 exerts a torque about the waist section 70. The abutment between the blade leg 58 and the blade body 54 prevents the waist section 70 from bending due to this torque. Third, the blade tab 60 is provided with additional strength to withstand the relatively strong force generated by the toggle spring connected thereto. This additional strength stems from the integrity of the primary blade 32. In particular, the blade tab 60 is formed within the integral lateral section 56, and the lateral section 56 is integrally connected to the blade body 54.

The primary blade 32 is designed to carry currents in excess of 100 amperes. In the primary blade 32, current flows from the moveable contact 30, through the lateral section 56 and the blade body 54, and to the interface 76 with the flexible connector 34. In order for the primary blade 32 to have a high current capacity, the moveable contact 30 is designed larger in size than the moveable contacts of existing blades. Similarly, the large lateral section 56 supporting the moveable contact 30 not only increases the current capacity of the blade 32, but also increases the interruption capacity of the blade 32. As the current flows through the lateral section 56 into the blade body 54, the current capacity of the blade 32 is increased due to the relatively long current path between the lateral section 56 and the flexible connector attachment region 76, as well as the relatively large thickness of the blade body 54. For high end interruption, a slide fiber 32 (FIG. 1) is hooked into the region 74 of the blade 32 and is used to provide the gas pressure to push the arc into the arc stack 13.

As an alternative embodiment to the blade shown in FIGS. 2 and 3, reference may be to the blade illustration and description in U.S. patent application Ser. No. 07/878648 (and its progeny and ancestors) (DC-0137), entitled "Automatic Miniature Circuit Breaker With Z-Axis Assemblable Trip Mechanism", filed Apr. 5, 1992, assigned to the instant assignee and incorporated herein by reference.

Those skilled in the art will readily recognize that various modifications and changes may be made to the present invention without departing from the true spirit and scope thereof, which is set forth in the following claims.

What is claimed is:

1. A high current capacity blade for a circuit breaker, comprising:

a conductive blade body having front and rear sections connected to one another, said rear section including a surface attachment area for fastening a flexible connector of the circuit breaker thereto;

a strain relief tang extending from said rear section of said blade body for engaging the flexible connector to stabilize the fastening of the flexible connector to the surface attachment area;

a broad conductive lateral section connected to and extending laterally from said front section, said broad lateral section including a blade tab for engaging a toggle spring of the circuit breaker;

a broad moveable contact mounted on said broad lateral section and adapted to interface with a stationary contact of the circuit breaker; and a pair of substantially parallel L-shaped blade legs spaced from one another to permit the toggle spring to pass therebetween, each of said blade legs having first and second ends, said first ends of said blades being connected to said rear portion of said blade body and said second ends including respective blade pivots for engaging notches in a handle of the circuit breaker.

2. The blade of claim 1, wherein said blade pivots are rounded to facilitate pivoting of the said blade pivots within the notches in the handle of the circuit breaker.

3. The blade of claim 1, wherein said strain relief tang extends laterally from said rear section in a substantially opposite direction relative to said broad conductive lateral section.

4. The blade of claim 1, wherein one of said blade legs abuts against said rear section to provide support to said blade body.

5. The blade of claim 1, wherein said rear section is wider than said front section and said front section is centrally connected to said rear section.

6. The blade of claim 1, further including a waist section extending laterally from said rear section in substantially the same direction as said lateral section, said waist section interconnecting said rear section and said pair of blade legs.

7. The blade of claim 1, wherein said lateral section is integrally formed and wherein said lateral section is integrally connected to said front section.

8. The blade of claim 1, wherein said blade legs are substantially parallel to said blade body.

9. A high current capacity blade for a circuit breaker, comprising:

a conductive blade body having generally co-planar front and rear sections integrally connected to one another, said rear section including a surface attachment area for fastening a flexible connector of the circuit breaker thereto;

a strain relief tang integrally connected to and extending from said rear section of said blade body for engaging the flexible connector to stabilize the fastening of the flexible connector to the surface attachment area;

a broad conductive integral lateral section integrally connected to and extending laterally from said front section, said broad lateral section including a blade tab for engaging a toggle spring of the circuit breaker;

a broad moveable contact mounted on said broad lateral section and adapted to interface with a stationary contact of the circuit breaker;

a waist section integrally connected to and extending laterally from said rear section in substantially the same direction as said lateral section; and a pair of substantially parallel L-shaped blade legs positioned substantially parallel to said blade body and spaced from one another to permit the toggle spring to pass therebetween, each of said blade legs having first and second ends, said first ends of said blades being integrally connected to said waist section and said second ends including respective blade pivots for engaging notches in a handle of the circuit breaker.

* * * * *